United States Patent [19]

Asayama

[11] Patent Number: 4,768,483

[45] Date of Patent: Sep. 6, 1988

[54] THROTTLE VALVE CONTROL APPARATUS FOR AN AUTOMOBILE

[75] Inventor: Yoshiaki Asayama, Himeji, Japan

[73] Assignee: Mitsubishi Denki Kabushiki Kaisha, Japan

[21] Appl. No.: 99,593

[22] Filed: Sep. 22, 1987

[30] Foreign Application Priority Data

Sep. 29, 1986 [JP] Japan ..... 61-230966

[51] Int. Cl.[4] ..... F02D 31/00

[52] U.S. Cl. ..... 123/399; 123/361

[58] Field of Search ..... 123/361, 399, 376, 352

[56] References Cited

U.S. PATENT DOCUMENTS

| | | | |
|---|---|---|---|
| 4,304,202 | 12/1981 | Schofield | 123/376 |
| 4,409,940 | 10/1983 | Gaus | 123/361 |
| 4,601,271 | 7/1986 | Ejiri | 123/399 |
| 4,703,823 | 11/1987 | Yogo | 123/399 |
| 4,724,811 | 2/1988 | Maisch | 123/399 |

FOREIGN PATENT DOCUMENTS

| | | | |
|---|---|---|---|
| 3146652 | 6/1983 | Fed. Rep. of Germany | 123/399 |
| 60-216036 | 10/1985 | Japan | 123/399 |

OTHER PUBLICATIONS

"Ward's Engine Update", Jun. 1, 1985, p. 5.

*Primary Examiner*—Ronald B. Cox
*Attorney, Agent, or Firm*—Leydig, Voit & Mayer

[57] ABSTRACT

A throttle valve control apparatus with two electronically-controlled actuators is disclosed. A first electronically-controlled actuator has a first drive motor which opens and closes the throttle valve through gears. A second electronically-controlled actuator has a second drive motor which opens and closes the throttle valve by rotating the first drive motor about the axis of the shaft of the throttle valve. The throttle valve can be independently rotated by either of the actuators. A controller computes the optimal degree of opening of the throttle valve based on the operating state of the engine of the vehicle, the running condition of the vehicle, and the amount by which the accelerator pedal is depressed. The controller then controls the actuators so as to open the throttle valve by the optimal degree of opening.

3 Claims, 1 Drawing Sheet

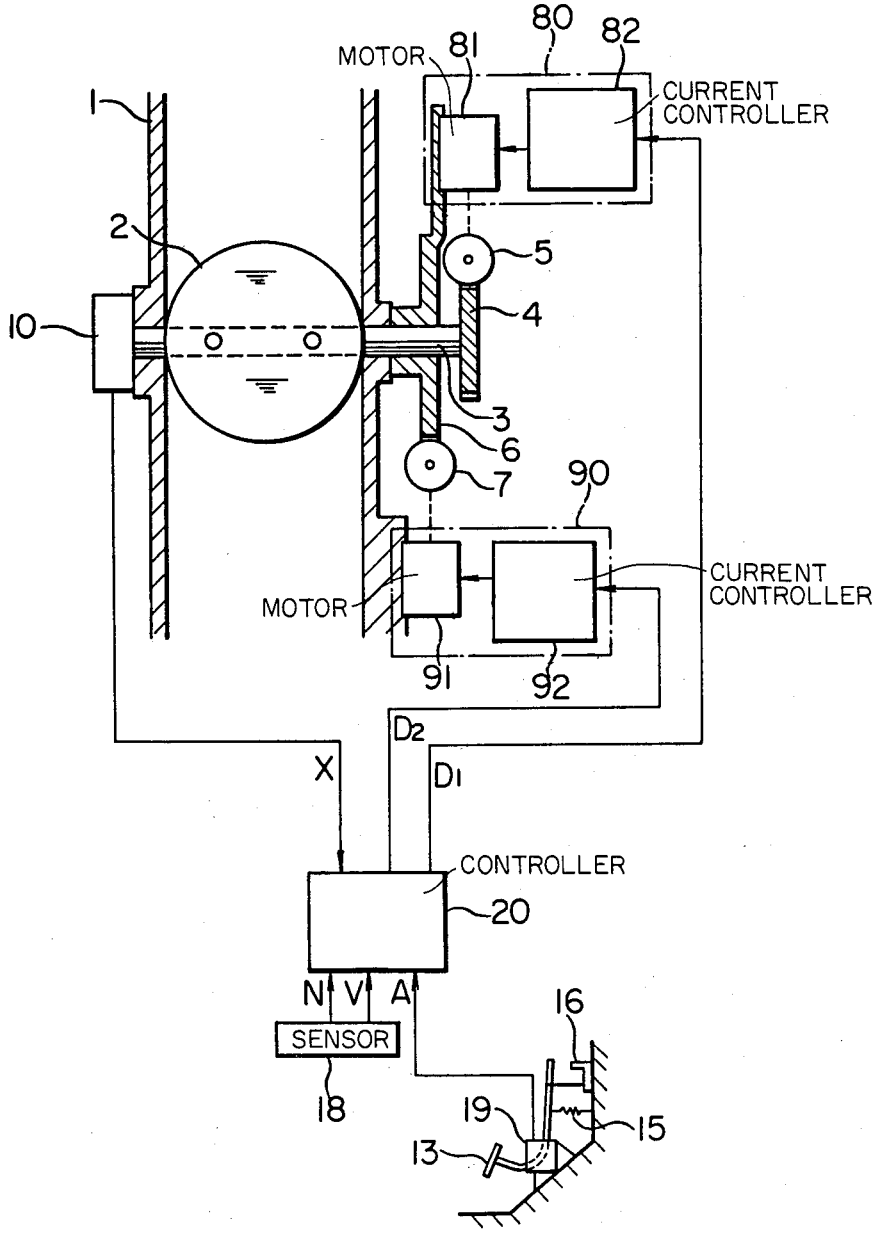
MOTOR
81
80
82
CURRENT CONTROLLER
1
2
5
4
10
3
6
7
90
CURRENT CONTROLLER
MOTOR
91
92
D2
X
D1
CONTROLLER
20
N
V
A
SENSOR
18
16
19
15
13

THROTTLE VALVE CONTROL APPARATUS FOR AN AUTOMOBILE

BACKGROUND OF THE INVENTION

This invention relates to an apparatus for controlling the throttle valve of the engine of an automotive vehicle, the term "automotive vehicle" being used herein to include passenger vehicles, trucks, tractors, and other vehicles which are powered by an internal combustion engine.

Up to the present time, the mechanism for opening and closing the throttle valve of an automotive engine was generally a mechanical linkage connected between the throttle valve and the accelerator pedal of the vehicle. In recent years, however, a throttle valve control mechanism has been developed which opens and closes the throttle valve using an electronically-controlled actuator. The actuator includes an electric drive motor which rotates the throttle valve in response to electric signals from a controller. The controller calculates the optimal degree of throttle opening based on the amount by which the accelerator pedal is depressed by the driver, on the operational state of the engine (indicated, for example, by the engine rotational speed), and on the running condition of the vehicle (indicated, for example, by the speed of the vehicle or by which gears are engaged). The controller then outputs suitable electrical control signals to the actuator. As there is no mechanical linkage between the throttle valve and the accelerator pedal, play and frictional losses which are inherent drawbacks of a mechanical linkage are avoided.

However, if the electronically-controlled actuator of such a throttle valve control mechanism becomes inoperable, depressing the accelerator pedal has no effect on the throttle valve. Therefore, a vehicle which has this type of throttle valve control mechanism must be equipped with a safety device which prevents the vehicle from running with the throttle stuck in an open position should the actuator become inoperable. Usually, this safety device is one which closes the throttle valve when the actuator malfunctions. Japanese Patent Application Laid-Open No. 55-145867 (1980) discloses a number of such safety devices. One which is disclosed therein is a safety device comprising a return spring which is mounted on the shaft of a throttle valve and closes the throttle valve when the control apparatus for the throttle valve malfunctions. Another is a safety device comprising an electromagnetic clutch which disconnects an electronically-controlled actuator from the shaft of the throttle valve when the throttle valve control apparatus malfunctions. A third safety device comprises a return spring and an electromagnetic clutch, the return spring being released so as to close the throttle valve when the electromagnetic clutch is released.

However, as these safety devices close the throttle valve when the actuator malfunctions, the vehicle becomes unable to move under its own power. Therefore, when the throttle valve control apparatus malfunctions, the vehicle must be towed by another vehicle to a garage and be repaired.

SUMMARY OF THE INVENTION

It is therefore an object of the present invention to provide a throttle valve control apparatus for an automotive vehicle of the type employing an electronically-controlled actuator which is more reliable than a conventional control apparatus of this type.

It is another object of the present invention to provide a throttle valve control apparatus for an automotive vehicle which has a faster response than a conventional control apparatus.

A throttle valve control apparatus for an automotive vehicle in accordance with the present invention is equipped with two drive means which are each capable of rotating the throttle valve independently of the other drive means. Namely, it is equipped with a first drive means for rotating the throttle valve, and a second drive means for rotating the throttle valve and the first drive means as a single unit. As each of the drive means can rotate the throttle valve, the vehicle can continue to run even when one of the drive means is inoperable.

The throttle valve control apparatus is further equipped with a first sensing means which senses the degree of opening of the throttle valve, a second sensing means which senses the operational state of the engine, a third sensing means which senses the running condition of the vehicle, and a fourth sensing means which senses the amount by which the driver of the vehicle has depressed the accelerator pedal. Each of the sensing means produces an output signal corresponding to the parameter which it measures.

A controller is provided which is responsive to each of the above sensing means. The controller calculates the optimal degree of throttle opening based on the output signals from the first through fourth sensing means and controls the first and second drive means so that the actual degree of throttle opening equals the optimal value.

In a preferred embodiment, the first drive means comprises a first drive motor and a first gear, the first gear being secured to the shaft of the throttle valve so as to rotate therewith and being rotated by the first drive motor. The second drive means comprises a second drive motor and a second gear, the second gear being rotatably supported by the shaft of the throttle valve and being rotated by the second drive motor. The first drive motor is secured to the second gear so as to rotate therewith.

In a preferred embodiment, the second sensing means for sensing the operational state of the engine is a sensor which measures the rotational speed of the engine, and the third sensing means for sensing the running condition of the vehicle is a sensor which measures the vehicle speed.

BRIEF DESCRIPTION OF THE DRAWING

The sole FIGURE is a partially cross-sectional schematic view of an embodiment of a throttle valve control apparatus in accordance with the present invention.

DESCRIPTION OF THE PREFERRED EMBODIMENT

Hereinbelow, a preferred embodiment of a throttle valve control apparatus in accordance with this invention will be described while referring to the accompanying FIGURE, which is a schematic view of this embodiment. As shown in the FIGURE, a throttle valve 2 is pivotably disposed in the carburetor barrel 1 of the engine of an automobile. The throttle valve 2 is a butterfly valve and comprises a disk which is secured to a rotating valve shaft 3 which is journalled by the walls of the carburetor barrel 1.

A first gear 4 which is coaxial with respect to the valve shaft 3 is secured to one end thereof. A second gear 6 is loosely mounted on the valve shaft 3 so as to be able to freely rotate thereon. The first gear 4 meshes with a drive pinion 5 which is mounted on the output shaft of a first drive motor 81 so as to rotate therewith. The first drive motor 81 is secured to the outer periphery of the second gear 6 so as to rotate therewith. The supply of current to the first drive motor 81 is controlled by a first current control circuit 82. The first drive motor 81 and the current control circuit 82 together constitute a first electronically-controlled actuator 80. The first gear 4, the drive pinion 5, and the first drive motor 81 together constitute a first drive means for rotating the throttle valve 2.

The second gear 6 meshes with another drive pinion 7 which is mounted on the output shaft of a second drive motor 91 so as to rotate therewith. The second drive motor 91 is secured to the outside of the carburetor barrel 1. The supply of current to the second drive motor 91 is controlled by a second current control circuit 92. The second drive motor 91 and the second current control circuit 92 together constitute a second electronically-controlled actuator 90. The second gear 6, drive pinion 7, and the second drive motor 91 together constitute a second drive means for rotating the throttle valve 2 and the first drive means as a single unit.

The degree of opening X of the throttle valve 2 is detected by a rotation sensor 10 which produces an electrical output signal corresponding to the angle of rotation of the throttle valve 2. The rotation sensor 10 may be in the form of a potentiometer.

Another sensor 18 detects the rotational speed N of the engine and the speed V of the vehicle and produces corresponding electrical output signals. The rotational speed N is an indication of the operational state of the engine, and the speed V is an indication of the running condition of the vehicle.

The accelerator pedal 13 of the vehicle has a return spring 15 which biases it towards a stopper 16. A position sensor 19 is mounted on the accelerator pedal 13. This sensor 19 measures the amount A by which the accelerator pedal 13 is depressed and produces a corresponding electrical output signal.

The output signals corresponding to X, N and V, and A from the three sensors 10, 18, and 19, respectively, are input to a controller 20. Based on the values of N, V, and A, the controller 20 performs a predetermined calculation to determine a target value Xt for the angle of opening of the throttle valve 2. The controller 20 compares the target value Xt with the actual angle of oepning X, which is indicated by the output from the rotation sensor 10. The controller 20 then sends command signals D1 and D2 to the first and second electronically-controlled actuators 80 and 90, respectively. Based on these command signals, one or both of the drive motors 81 and 91 of the actuators are rotated until the actual angle of opening X equals the target value Xt. The command signals D1 and D2 include halt commands, run commands, and commands which determine the direction of rotation of the drive motors.

The throttle valve 2 can be opened and closed by operating either one or both of the drive motors. If only the first drive motor 81 is turned on, the first drive motor 81 rotates drive pinion 5, which in turn rotates the first gear 4. The throttle valve 2 and the valve shaft 3 then rotate as a unit with the first gear 4.

If only the second drive motor 91 is turned on, drive pinion 7 rotates the second gear 6 about the axis of the throttle valve shaft 3. As the first drive motor 81 is secured to the second gear 6, the second gear 6 and the first drive motor 81 rotate together. The engagement between drive pinion 5 and the first gear 4 causes the first gear 4 to rotate, even though drive pinion 5 does not rotate on its own axis. The throttle valve 2 rotates together with the first gear 4, and as a result, the first drive motor 81 and the throttle valve 2 are rotated as a single unit.

On the other hand, if both drive motors are operated at the same time, the first drive motor 81 is carried about the axis of the valve shaft 3 at the same time that the first drive motor 81 rotates the throttle valve 2 by driving drive pinion 5. In this case, the rotation of the throttle valve 2 due to the operation of the first drive motor 81 is added to the rotation due to the operation of the second drive motor 91. The resulting speed of rotation of the throttle valve 2 is roughly twice as fast as the speed of rotation when only one of the drive motors is operated.

It can be seen that as long as at least one of the electronically-controlled actuators is functioning properly, the throttle valve 2 can be effectively controlled. In other words, even when one of the actuators is inoperable, the vehicle can continue to run normally. Therefore, this throttle valve control apparatus is far more reliable than a conventional control apparatus having only a single actuator.

What is claimed is:

1. A throttle valve control apparatus for controlling the throttle valve of the engine of an automotive vehicle comprising:

first drive means for rotating said throttle valve;

second drive means for rotating said throttle valve and said first drive means as a single unit;

first sensing means for sensing the degree of opening of siad throttle valve and producing a corresponding output signal;

second sensing means for sensing the operational state of said engine and producing a corresponding output signal;

third sensing means for sensing the running condition of said vehicle and producing a corresponding output signal;

fourth sensing means for sensing the amount by which the driver has depressed the accelerator pedal of the vehicle; and control means responsive to the output signals of said first through fourth sensing means for determining the optimal degree of opening of said throttle valve based on the engine operational state, on the running condition of the vehicle, and on the amount of depression of the accelerator pedal and for controlling said first and second drive means so that the actual degree of opening of said throttle valve equals said optimal value.

2. A throttle valve control apparatus as claimed in claim 1, wherein:

said throttle valve is a butterfly valve comprising a plate and a valve shaft which is rigidly secured to said plate and which is rotatably supported in an air intake passageway of said engine;

said first drive means comprises a first drive motor and a first gear which is coaxially secured to said valve shaft and is connected to said first drive motor so as to be rotated thereby; and said second drive means comprises a second drive motor and a second gear which is rotatably mounted on said valve shaft and is connected to said second drive motor so as to be rotated thereby, said first drive motor being secured to said second gear so as to rotate therewith.

3. A throttle valve control apparatus as claimed in claim 1, wherein:

said second sensing means comprises means for sensing the rotational speed of said engine; and said third sensing means comprises means for sensing the speed of said vehicle.

* * * * *